US008852498B1

(12) United States Patent
Wedding

(10) Patent No.: US 8,852,498 B1
(45) Date of Patent: Oct. 7, 2014

(54) BERYLLIUM MICROSPHERES

(75) Inventor: Carol Ann Wedding, Toledo, OH (US)

(73) Assignee: Imaging Systems Technology, Inc., Toledo, OH (US)

( * ) Notice: Subject to any disclaimer, the term of this patent is extended or adjusted under 35 U.S.C. 154(b) by 28 days.

(21) Appl. No.: 13/451,695

(22) Filed: Apr. 20, 2012

Related U.S. Application Data

(60) Provisional application No. 61/477,252, filed on Apr. 20, 2011.

(51) Int. Cl.
*B22F 3/10* (2006.01)
*B22F 5/10* (2006.01)

(52) U.S. Cl.
USPC ..... 419/5; 419/36; 419/37; 419/40; 419/53; 419/57

(58) Field of Classification Search
USPC ..... 419/5, 8, 9, 36, 37
See application file for complete search history.

(56) References Cited

U.S. PATENT DOCUMENTS

| | | | | |
|---|---|---|---|---|
| 3,674,461 | A * | 7/1972 | Farnand | 428/544 |
| 4,205,278 | A | 5/1980 | George et al. | |
| 4,380,855 | A | 4/1983 | Deckman et al. | |
| 4,608,222 | A | 8/1986 | Brueckner | |
| 4,917,857 | A * | 4/1990 | Jaeckel et al. | 419/9 |
| 5,855,638 | A | 1/1999 | Demars | |
| 6,554,882 | B1 * | 4/2003 | Zhou et al. | 75/228 |
| 6,590,954 | B1 | 7/2003 | Koch | |
| 7,163,121 | B1 | 1/2007 | Stouffer et al. | |
| 7,182,951 | B1 | 2/2007 | Balachander et al. | |
| 7,579,069 | B2 | 8/2009 | Hougham et al. | |
| 7,776,255 | B1 * | 8/2010 | Wedding et al. | 419/5 |
| 7,804,077 | B2 | 9/2010 | Danese et al. | |
| 8,006,759 | B1 * | 8/2011 | Cochran et al. | 166/280.2 |
| 2007/0166541 | A1 * | 7/2007 | Smith et al. | 428/402 |
| 2009/0194712 | A1 | 8/2009 | Danese | |

* cited by examiner

*Primary Examiner* — George Wyszomierski
*Assistant Examiner* — Ngoclan T Mai
(74) *Attorney, Agent, or Firm* — Donald K. Wedding

(57) ABSTRACT

A process for fabricating hollow metal shells such as Be or Al filled with a selected gas such as D or T. An organic preform is coated with a slurry of organic binder and metal powder of Be or Al. The coated preform is heated to remove the preform and any organics to form a hollow shell which is then fired at an elevated temperature in a gas so as to seal the shell and capture the gas inside the sealed shell.

23 Claims, 5 Drawing Sheets

BERYLLIUM MICROSPHERES

RELATED APPLICATION

This application claims priority under 35 U.S.C 119(e) for Provisional U.S. Patent Application Ser. No. 61/477,252 filed Apr. 20, 2011, incorporated herein by reference.

BACKGROUND

Nuclear fusion is the process by which two or more atomic nuclei join together, or "fuse", to form a single heavier nucleus. This is usually accompanied by the release or absorption of large quantities of energy.

The fusion of two nuclei with lower masses than iron generally releases energy. In theory it is possible to build nuclear reactors that deliver ten times more fusion energy then is required to cause the fusion reaction. However these large-scale thermonuclear fusion processes, involving many nuclei fusing at once, must occur in matter of very high densities and temperatures. One way to achieve controlled fusion is to apply a rapid pulse of energy to the surface of a microcapsule or pellet of fusion fuel, causing it to "implode" and heat to very high pressure and temperature. If the fuel is dense enough and hot enough, the fusion reaction rate will be high enough to burn a significant fraction of the fuel before it has dissipated. To achieve these extreme conditions, the initially cold fuel must be explosively compressed.

Laser inertial confinement is a fusion technique that uses a laser as an energy source to implode a microcapsule filled with fuel. One type of microcapsule used in this application is a hollow shell of beryllium doped with copper and filled with gas of deuterium (D) at a pressure of nominally 20 atmospheres. These beryllium shells are nominally 2 mm in diameter with shell walls nominally 100 μm thick.

Copper doped beryllium hollow shells are made by sputter deposition of beryllium with a radially graded copper dopant onto plastic mandrels. Shell walls have been reported between 20 μm to 100 μm thick. A small hole of nominally 6 μm or less in diameter is laser drilled into the shell wall. The hole is used as an escape hatch to remove the organics of the mandrel during pyrolization. By forcing hot air at about 450° C. into and out of the shell, the plastic mandrel is pyrolized with outgassing through the 6 μm hole. The 6 μm hole is also used as the opening to fill the shells with the deuterium gas. After filling, the hole is sealed by positioning the shell on an XYZ stage where UV glue is applied using two microscopic cameras and a metal tube.

There are a number of challenges associated with this process. Laser drilling the hole requires precision so as not to cut through to the other side of the shell. Pyrolization is challenging because it is difficult to get air in and out of the small opening. Because the hole is quite small, gas flow through the orifice must be forced with an external pressure variation. Further calculations showed that because the volume of the capsule is quite small and the amount of plastic in the shell by comparison is large, the "pumping" of air in and out of the shell must occur at least once per minute in order to supply enough $O_2$ to completely burn the plastic to $CO_2$ and $H_2O$ in a reasonable time. After removal of the mandrel, the shell is pressurized and sealed at about 20 atmospheres with 99.6% D. This is done by placing the shell in a pressurized chamber on an XYZ stage viewed with two microscope cameras As shown in the FIG. 5 prior art process, the shell is positioned using the cameras and stage and UV glue is applied with a metal tube attached to a modified valve in the top of the shell. This process requires "hand crafting" of each shell and cannot be economically scaled to production quantity needed to sustain a nuclear fusion reactor.

PRIOR ART

The following are incorporated herein by reference: U.S. Pat. No. 4,205,278 (George et al.), U.S. Pat. No. 4,380,855 (Deckman et al.), U.S. Pat. No. 4,608,222 (Brueckner), U.S. Pat. No. 5,855,638 (Demars), U.S. Pat. No. 6,590,954 (Koch), U.S. Pat. No. 7,163,121 (Stouffer et al.), U.S. Pat. No. 7,182,951 (Balachander et al.), U.S. Pat. No. 7,579,069 (Hougham et al.), U.S. Pat. No. 7,804,077 (Danese et al.), and U.S. Patent Application Publication No. 2009/0194712 (Danese).

SUMMARY OF INVENTION

This invention relates to a process for producing hollow shells filled with a gas at a selected pressure. In accordance with this invention, a solid or semi-solid organic core of predetermined geometric shape is coated with an aqueous suspension of inorganic particles and water. In one embodiment, the inorganic particles are incorporated with a binder. The coated core is heated to a temperature sufficient to remove the organic core, binder, and water so as to form a porous bisque shell of inorganic particles with a hollow center. In this bisque state, the shell is submerged in an atmosphere of gas at a predetermined pressure. The gas-submerged bisque shell is heated to an elevated temperature sufficient to sinter the shell so as to trap and/or form an impervious seal and retain the gas inside the shell.

At the elevated temperature, the pressure of the gas inside the shell is maintained at a predetermined pressure greater than the desired final shell pressure in the shell. After the shell is sintered and sealed in situ while submerged in the gas and cooled the gas pressure inside the cooled shell decreases to the desired pressure.

The shell may be of any suitable volumetric shape or geometric configuration to encapsulate the gas. The volumetric and geometric shapes include but are not limited to spherical, oblate, spheroid, prolate spheroid, capsular, elliptical ovoid, egg shape, bullet shape, pear, tear drop, disc, or dome. In the embodiment disclosed herein, the shell is typically a sphere.

A sphere is a hollow spherical shell with relatively uniform shell thickness. The shell is typically composed of a selected material and is filled with a selected gas at a desired pressure. Additional beneficial materials may be added to the inside or outside surface of the shell. Substances may also be added directly to the shell material.

The organic core is selected from one or more organic materials including polymeric materials having low molecular weight, low vapor pressure, and low boiling temperature. The organic core is also selected based on the chemical and physical properties of the selected inorganic particles and the processing conditions including temperatures required to form the shells. The selected organic core must have the proper vaporization, pyrolization, sublimation, oxidation, and/or decomposition properties without leaving a harmful carbonaceous or other residue which would interfere with the use and operation of the shell.

The solid organic core comprises any suitable solid organic or solid polymeric material which vaporizes, pyrolizes, sublimes, oxidizes, and/or decomposes at a selected temperature without leaving a detectable carbonaceous or other deleterious residue. The core may be solid or partially solid.

Examples of suitable organic cores are the polyacrylates including polyakylacrylates such as polymethylacrylate, polyethylacrylate, polypropylacrylate, and polybutylacrylate.

The organic core may also be selected from alkyl esters of acrylic acid. These include the alkyl acrylate esters such as methylacrylate, ethylacrylate, propylacrylate, butylacrylate, pentylacrylate, hexylacrylate, 2-ethylhexylacrylate. Also the esters of methacrylic acid such as methyl (meth) acrylate, ethyl(meth)acrylate, propyl(meth)acrylate, butyl(meth)acrylate, amyl(meth)acrylate, hexyl(meth)acrylate, heptyl(meth) acrylate, octyl(meth)acrylate, nonyl(meth)acrylate, decyl (meth)acrylate, and 2-ethylhexyl(meth)acrylate.

Other suitable organic cores include polystyrenes, and substituted polystyrenes as set forth below. Also there may be used polyvinyl acetate, polyvinyl alcohol, polybutyrol, cellulose ester, and cellulose nitrate.

The selected polystyrene including substituted polystyrenes is typically foamed, expanded, or pre-puffed. Solid poly (alpha-substituted) styrenes are particularly suitable and include those styrenes having the structure:

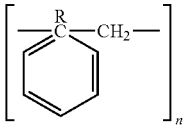

where n is an integer greater than 1 and R is selected from alkyls of about 6 carbons or less, e.g., methyl, ethyl, propyl, butyl, pentyl, isopropyl, isobutyl, isopentyl, neopentyl and hexyl. The inorganic particles are selected from any finely divided particulates including powders typically suitable for incorporation with a selected binder to form the suspension. Examples of inorganic particles include materials containing oxides, carbides, nitrides, nitrates, silicates, aluminates, phosphates, borates, borides, and other compounds of metals and/or metalloids such as silicon, germanium, aluminum, gallium, magnesium, titanium, zirconium, zinc, chromium, and so forth. Some specific examples include particles of aluminum oxide, magnesium oxide, chromium oxide, zirconium oxide, silicon carbide, silicon nitride, ceramic, glass, glass ceramic, refractory, fused silica, quartz, and mixtures thereof.

Mixtures of inorganic particles may be used to coat the organic core. For production of metal-containing ceramic hollow shells, it is possible to use metal powders and the corresponding metal oxide powders or combinations thereof. Elements which form easily reducible oxides, such as Fe, Ni, Co, Cu, W, and Mo, can be used in the form of the oxides and reduced to elemental metal at least in part during the sintering process. Inorganic metallic powder particles may be selected from metals of the group Fe, Co, Ni, Cu, W, Mo, noble metals (e.g. gold, platinum, iridium) and hard metals (e.g. titanium and tantalum).

The inorganic particles are added to an aqueous medium to form an aqueous suspension, slurry, colloidal dispersion, mixture, solution, or the like. Suspension as used herein includes slurry, dispersion, mixture, solution, or the like. The inorganic particles have a typical particle size of about 0.1 to about 10 microns.

In one embodiment, the inorganic particles are incorporated with a binder, particularly an organic binder. The organic binder may be selected from the same class of materials listed above for the organic cores. The organic binder may be selected from one or more organic solutes and solvents including polymeric materials having low molecular weight, low vapor pressure, and low boiling temperature. The binder may also be selected based on the chemical and physical properties of the selected inorganic particles and the processing conditions including temperatures required to form the shell. The selected binder must have the proper vaporization, pyrolization, sublimation, oxidation, and/or decomposition properties without leaving a harmful carbonaceous or other residue which would interfere with the use and operation of the shell.

Examples of suitable organic binders are the polyacrylates including polyakylacrylates such as polymethylacrylate, polyethylacrylate, polypropylacrylate, and polybutylacrylate. The binder may also be selected from alkyl esters of acrylic acid. These include the alkyl acrylate esters such as methylacrylate, ethylacrylate, proplyacrylate, butylacrylate, pentylacrylate, hexylacrylate, 2-ethylhexylacrylate. Also the esters of methacrylic acid such as methyl(meth)acrylate, ethyl(meth)acrylate, propyl(meth)acrylate, butyl(meth)acrylate, amyl(meth)acrylate, hexyl(meth)acrylate, heptyl(meth)acrylate, octyl(meth)acrylate, nonyl(meth)acrylate, decyl(meth) acrylate, and 2-ethylhexyl(meth)acrylate.

Other suitable organic binders include polystyrenes, and substituted polystyrenes as set forth above for the solid organic core. Also there may be used polyvinyl acetate, polyvinyl alcohol, polybutyrol, cellulose ester, and cellulose nitrate.

Selected organic binders may also be used for the organic core, for example the polyacrylates, alkyl esters of acrylic acid, esters of methacryulic acid, and other binders listed above. In some embodiments, the organic core and organic binder may be the same or from the same chemical family.

Solid or semi-solid binders can be dissolved in a suitable solvent such as the alcohol solvent series or ethers such as tetrahydrofuran (THF), dimethylethylene glycol (Diglyne), and diethylene glycol monoethyl ether. Other solvents include diacetone alcohol, n-butyl acetate, 2-nitrol propane, the carbitols, and 2-ethoxy-ethanol-1. The aqueous suspension may also include one or more of the same or other solvents.

The aqueous suspension may also include suitable wetting and/or dispersing agents that may be incorporated into the suspension. Some selected agents include lecithins, mixed fatty acid esters of phosphatidyl choline, polyethylene sorbitol oleate laurate, polyethylene glycol lauryl ether, diethylene glycol monostearate, polyacrylic acid, ammonium salt of polyacrylic acid, and the like.

The process or method of this invention produces small hollow shells such as spheres filled with a selected gas. The shells produced in accordance with this invention have a uniform shell thickness and are filled with a gas of a predetermined composition and pressure.

In one embodiment, a solid organic core such as a solid polymeric material of a predetermined geometric shape is coated with an aqueous suspension, slurry, colloidal dispersion, or the like of inorganic particles with or without an organic binder. The green shell of coated particles on the core is heated at a temperature sufficient to remove the organic core (and binder if present) by vaporization, pyrolization, sublimation, oxidation and/or decomposition so as to form a porous bisque shell of inorganic particles with a hollow center. The porous bisque shell is submerged in an atmosphere of selected gas at a predetermined pressure. The gas-submerged bisque shell is then heated to an elevated temperature sufficient to sinter the shell and form an impervious shell seal so as to trap and retain the gas inside the shell.

Before sintering and gas filling, the bisque shells may be baked out under vacuum to remove any undesired impurities including organic residue(s) or other contaminants. This is typically done under vacuum at about $10^{-4}$ to about $10^{-8}$ mm of Hg at about 200° C. to about 400° C. The bake-out under vacuum is about 4 to about 10 hours.

At the elevated sintering and shell sealing temperature, the pressure of the gas inside the shell is maintained at a pressure greater than the desired final shell pressure. After the shell is sintered, sealed, and cooled, the pressure inside the shell decreases to the predetermined pressure. The result is an impervious shell containing the selected gas at a predetermined pressure.

The organic core particles are coated with the aqueous suspension of inorganic particles by any suitable means including spraying, dipping, tumbling, electrostatic deposition, powder bed, fluid bed, and the like.

In accordance with one embodiment of this invention, a fluid bed process is used to coat the organic cores. Foamed polystyrene core particles with a diameter of about 25 to 3000 microns are charged into a fluidized bed. A coating suspension of inorganic particles is introduced into the top of the fluidized bed formed by the foamed polystyrene core particles. The duration of the coating process depends on the required shell thickness and the flow rate and temperature of the fluidizing gas. The gas is typically heated air at about 70° C. to about 130° C. introduced at the bottom of the bed counterflow to the flow of the suspension introduced at the top of the fluid bed.

Water may be added to the aqueous suspension as needed. The aqueous suspension typically has about 10% to about 40% by weight inorganic particles contained in the suspension.

The shell may be of any suitable geometric shape. The final shape of the shell may be determined after processing or may be determined by shaping the organic cores or selecting the shape of the cores before or after coating.

The aqueous suspension of inorganic particles with or without organic binder is formulated such that the thickness of the inorganic coating will have an adequate strength in the green state so that the green shell of inorganic particles will not be deformed when the organic core is heated and removed. The polystyrene core particles are typically coated such that the sintered and sealed shell has a thickness of about 10 to about 200 microns.

The coated organic core is heated to pyrolize, vaporize, or otherwise remove the organic core. The pyrolized or vaporized core (and binder if present) escapes through the porous shell. There remains a self-supporting hollow porous bisque shell.

Depending upon the nature of the selected inorganic particles, removal of the coated organic core and binder may be carried out in air, oxygen, inert gas or under reducing conditions such as with hydrogen. Depending on the selected organic core and binder, the removal by pyrolysis, vaporization, sublimation, oxidation and/or decomposition of the organic core and binder typically requires heating for about 1 to about 6 hours at a temperature of about 200° C. to about 600° C.

In some embodiments, the strength of the shell may be increased by conducting the removal, of the core and binder, i.e., the pyrolysis, vaporization, etc. under oxidizing conditions such as in an oxygen rich environment so that any residual carboneous material is oxidized.

The heating at about 200° C. to about 600° C. serves to remove a portion if not all of the organic core and any binder that is present. This is followed by heating the shell at a temperature of about 600° C. to about 1200° C. for about 1 to about 5 hours to remove any residual core or binder and to strengthen the shell which is in a porous bisque state. This temperature must be sufficient to remove any residual core or binder and strengthen the bisque shell, but below the sintering temperature of the shell. The heating and removal of the core, binder, and forming of the bisque may be carried out in the same unit, such as in a fluidized bed reactor. Alternatively, it may be desirable to process the higher temperature bisque formation in a separate unit, such as a rotary kiln or a raking furnace. The atmosphere in the furnace unit is determined in consideration of the inorganic material used to form the shell. During the bisque formation, the shell may be heated in a vacuum, under oxidizing or reducing conditions or in an inert gas environment.

The hollow shells may be agitated to prevent them from sticking to each other during the sintering. The same result may be produced by coating the outer surface of the shells with an inert powder which at the temperatures employed will not undergo a chemical or physical reaction with the material of the hollow shell. After the sintering treatment such inert powders may be removed from the hollow shells by mechanical or chemical processing. Depending upon the material of the hollow shells, suitable inert powders include carbon, aluminum hydroxide, or chalk.

DETAILED DESCRIPTIONS OF THE DRAWINGS

Figure 1:
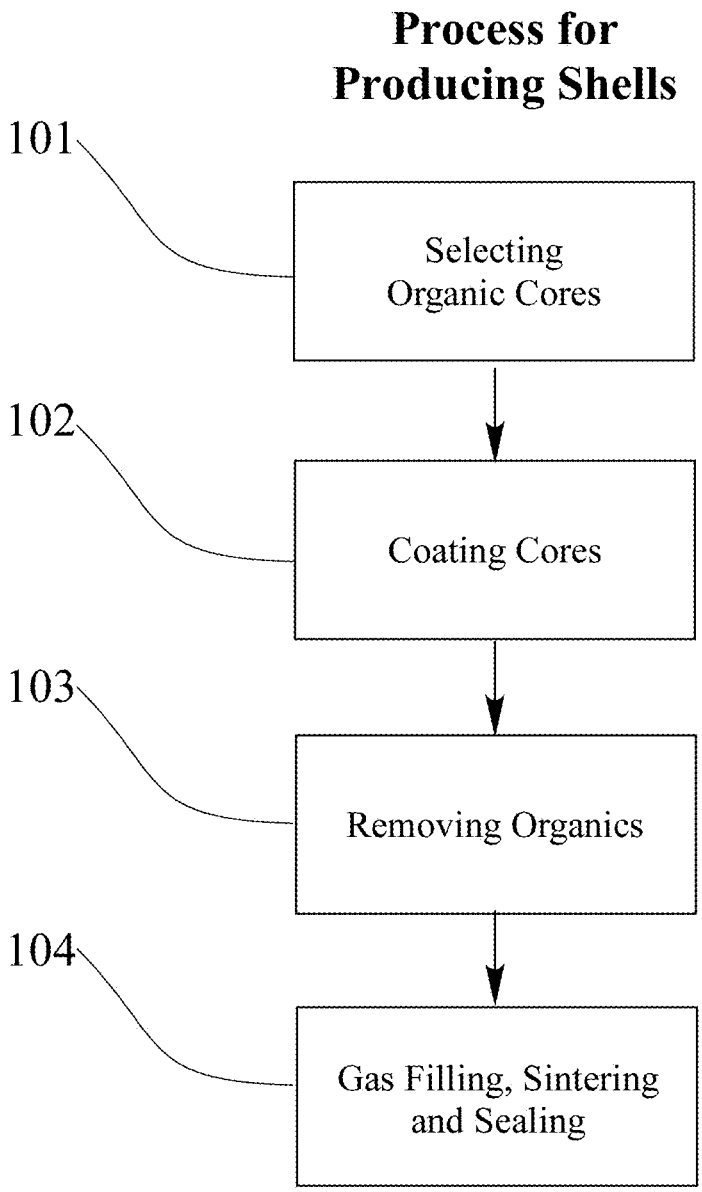
FIG. 1 is a block diagram of a process for producing shells.

FIG. 1 shows the process steps to produce hollow, gas filled shells.

In Step 101, solid organic cores of predetermined geometric shape and size are selected by sieve or other means to produce the desired inner diameter of the shell. Typically the cores are selected with a diameter of about 25% to about 50% greater than the desired shell diameter as the slurry of particles will tend to shrink as it is fired. The organic core may be selected based on shape and low density. Low density polystyrene beads of a predetermined shape are suitable for this application. Although sieving may be used as the first process step, the sieving may be repeated later in the process, for example after the formation of the bisque shells.

In Step 102, the organic core particles are coated with an aqueous suspension of inorganic particles, to form a green shell. The inorganic particle may be incorporated with an organic binder.

In one preferred embodiment, the inorganic particles include inorganic materials selected from metal compounds, metalloid compounds, and ceramics. One preferred material contemplated is beryllium.

In Step 103, the organic core and any organic binder are removed by heating to a temperature of about 200° C. to about 600° C., leaving only the bisque shell of inorganic particles with a hollow center. This may be further heated to about 600° C. to about 1200° C. to further strengthen the bisque shell.

In Step 104, the porous bisque shells are sintered in a select atmosphere and pressure and sealed at an elevated temperature typically about 1500° C. or higher. In the case of aluminum oxide, the sintering and sealing temperature is about 1600° C. To completely seal the shell, this temperature is held for about 6 hours or more. After this time, the shell is completely sealed and the selected gas is retained inside the shell. As the shells are cooled, the gas pressure in the shell decreases.

The shells may be baked out under vacuum before gas fill and sintering. The shells are placed in a vacuum oven which is purged and filled with the selected gas or mixture of gases.

When using an organic core, multiple coatings of suspension may be applied. These are referred to herein as precoatings. Successive coatings of identical materials or different materials may be applied to the core. In one embodiment, a first coating or layer of material (such as beryllium) is applied to the core. This is then coated by an aqueous suspension of inorganic shell material and will be exposed to the same temperature cycles as the shell material. These must be able to withstand the temperature cycles and withstand chemical reaction with other coatings.

Figure 2:
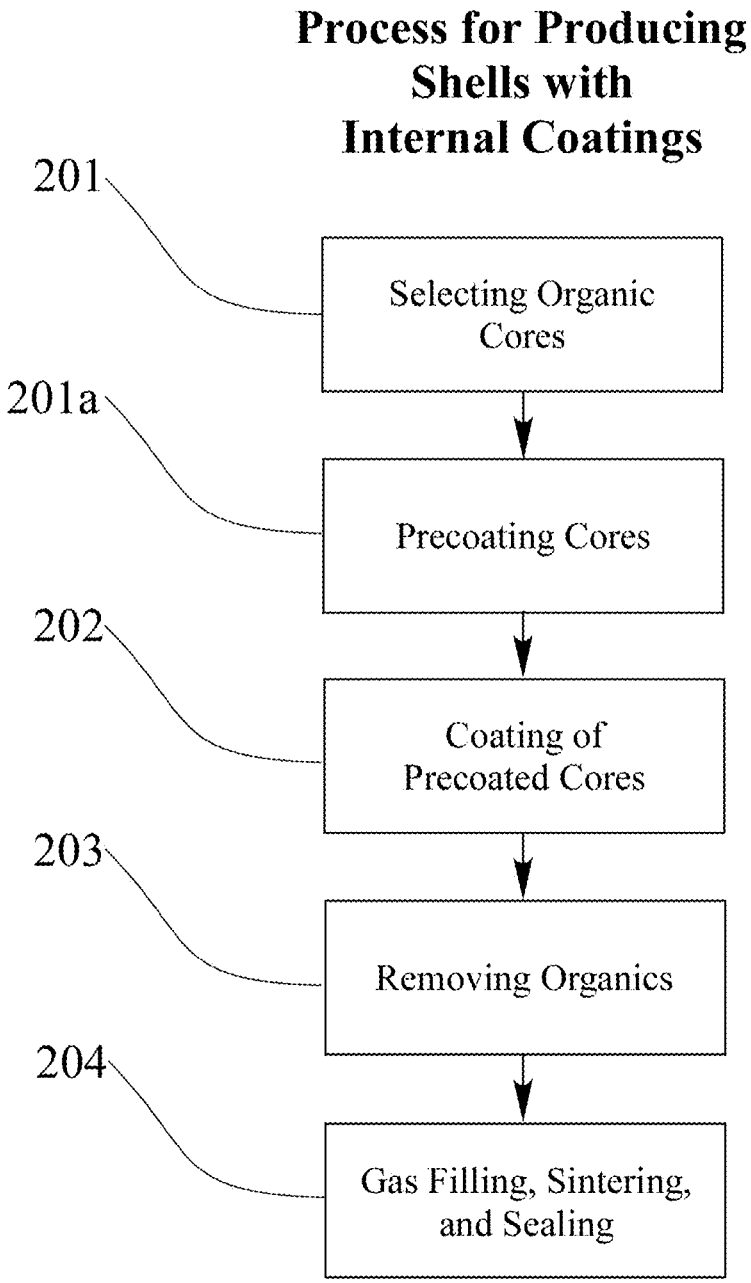
FIG. 2 is a block diagram of a process for producing a shell with internal coatings.

In the method shown in FIG. 2, one or more precoatings of various substances may be applied as method Step 201*a* between the core selection Step 201 and the coating Step 202.

Figure 3:
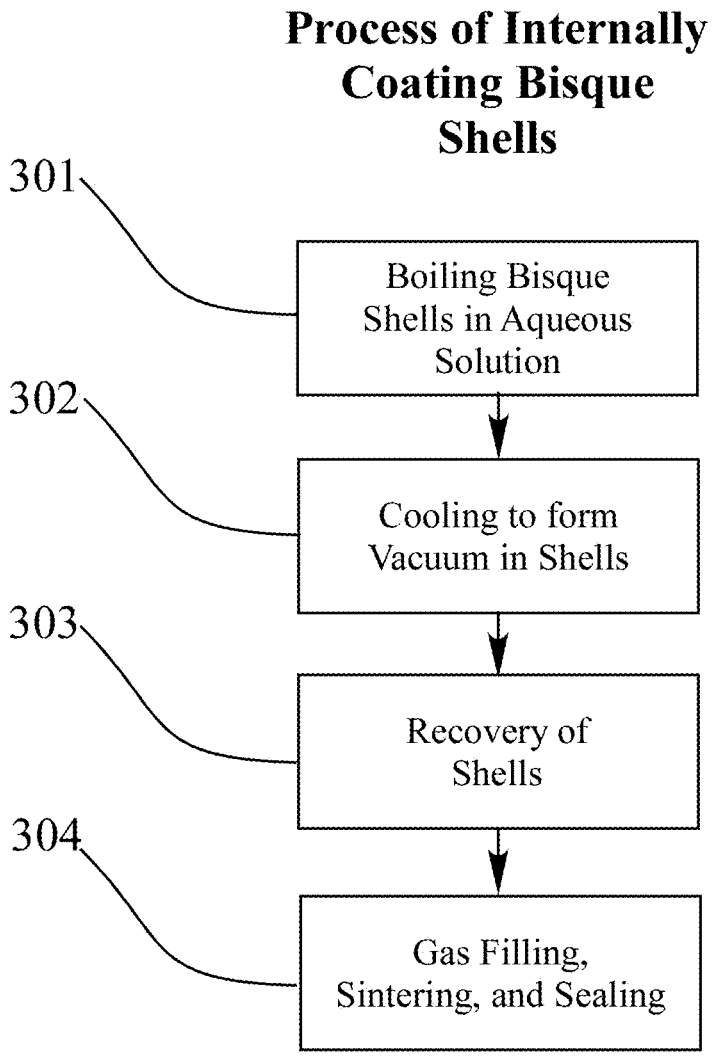
FIG. 3 is a block diagram of a process for internally coating bisque shells.

In another embodiment hereof, as illustrated in FIG. 3, there is shown a process for coating the interior of the shell. In Step 301, bisque shells are boiled in an aqueous suspension. As the bisque shells are heated, the gas within the hollow shell chamber expands and evacuates the chamber. In process Step 302, the solution is cooled, a vacuum is formed in the shell chamber and the aqueous solution is drawn in. By air drying or other heat cycles, the aqueous solution is evaporated in Step 303 leaving a coating inside the shell. In Step 304, the shell is gas filled, sintered, and sealed. This process results in a layer on the inside of the shell. Because this coating method is applied after the bisque shell is formed, it may be used in conjunction with any suitable shell forming processes that produce a porous bisque shell.

In one embodiment and mode hereof, the shell comprises a metal or metalloid oxide and is filled with a gas of about 99.99% atoms of neon and about 0.01% atoms of argon or. Examples of shell materials are disclosed herein and include silica, aluminum oxides, zirconium oxides, and magnesium oxides.

Figure 4:
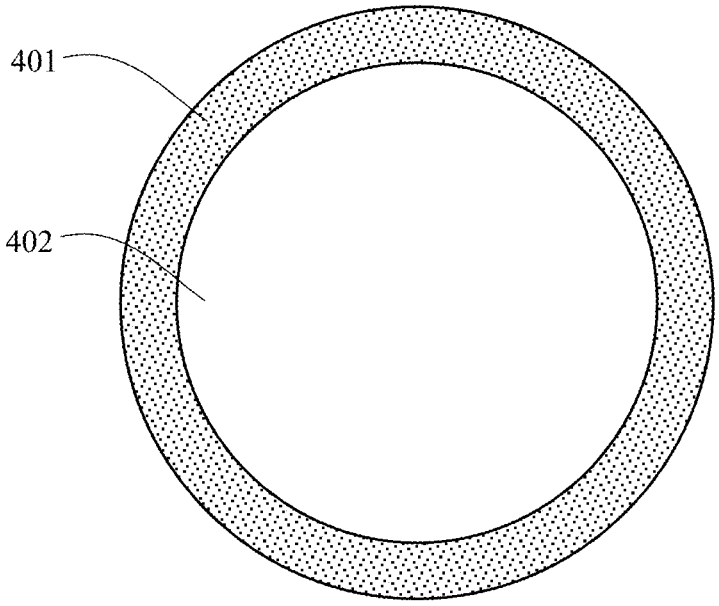
FIG. 4 shows a cross-section view of a shell embodiment.
Figure 5:
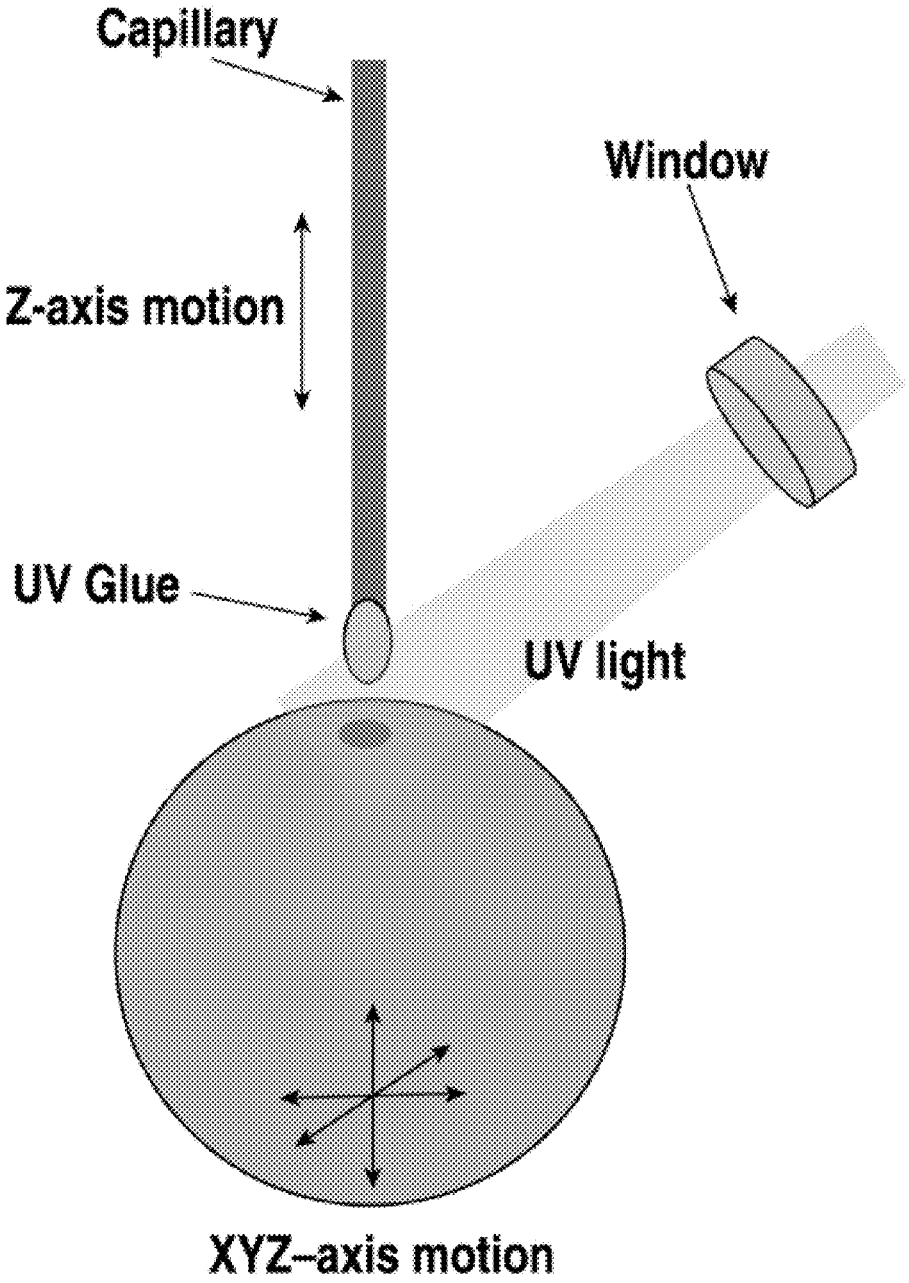
FIG. 5 is a prior art process discussed above.

FIG. 4 shows a hollow shell composed of beryllium. In this embodiment the hollow shell is a sphere composed essentially of beryllium 401 encapsulating a void 402. The void may be filled with a number of gases at various pressures. One useful gas contemplated in this embodiment is primarily a deuterium mixture at about 20 ATM. The beryllium shell may be beneficially doped with copper. The copper dopant may be controlled to have different concentrations throughout the shell diameter. Other shell shapes are possible including but not limited to cylindrical, cubic, or simplex.

In one embodiment, another material is applied to the exterior of the beryllium shell. This exterior material application may comprise a slurry or tumbling process with curing, typically at low temperatures. Infrared curing can also be used. The substance may be applied by other methods or processes including spraying, ink jet, and so forth.

For many applications, including nuclear targets it is desirable to keep the beryllium free from contamination particularly due to oxygen or carbon. Thus the process parameters and materials used in the process are crucial in preventing the introduction of contamination. For example when beryllium is heated in air or oxygen atmosphere temperatures should not exceed about 500° C. and more preferably below about 450° C. and even more preferably below about 425° C. to prevent the oxygen from penetrating the beryllium grain boundaries. To avoid the formation of beryllium carbide, beryllium should not be exposed to carbon at temperatures above about 900° C.

The first step is preparing the slurry. Beryllium powder is mixed with high purity water so that the solids content is about 5% to about 50% by weight. Beryllium powder is available at a mesh size of about −325. Mesh sizes of −200 have been reported in the industry with an oxygen content of 4000 parts per million (ppm). This is unavoidable due to a thin oxide layer forming when beryllium is exposed to air. Preferably the solids content of the slurry is between about 15% to about 30% by weight. The slurry is mixed in a jar in the presence of ceramic grinding material. The slurry may be jar milled for about 2 to about 24 hours at room temperature, preferably about 8 to about 12 hours. A binder is then added to the slurry so that the final slurry is composed of x part of binder for 1 part of beryllium powder with $0.005<x<0.50$, preferably with $0.01<x<0.1$. The binder is selected such that it will pyrolize in air at a temperature not exceed about 500° C. and more preferably below about 450° C. and even more preferably below about 425° C. Additionally, the select binder will burn cleanly without leaving traces of carbon. Such binders include but are not limited to polyvinyl alcohol.

The second step is coating the preforms. The prepared slurry is sprayed onto polymer cores. Suitable cores are any material that will burn cleanly at temperature not exceeding about 500° C., preferably below about 450° C., and more preferably below about 425° C. Cores may be of any beneficial shape and of any suitable material. Polystyrene cores may be coated to any thickness. Some shrinkage may occur as the shells pass through various heat treatments. Coats may be applied in layers to achieve various concentrations of dopants from the inner to the outer coating.

The third step is removing organics. The coated cores are fired in a bisque oven at the appropriate temperature to allow complete burnout of the preformed cores and binder. Bisque temperature should not exceed about 500° C., preferably below about 450° C., and more preferably below about 425° C.

The fourth step is firing the shells. Shells fired in a given pressurized atmosphere will sinter impervious and seal the given pressurized gas within the shell interior. To fabricate beryllium shells with a final pressure of nominally 20 ATM of deuterium or deuterium doped with argon or other gas, the shells are heated to a temperature of about 1000° C. to about 1300° C. at a pressure of about 85 ATM to about 110 ATM. This processing can be accomplished in a high temperature isostatic press (HIP) furnace modified to handle pressurized deuterium.

Hollow beryllium shells also have utility in other applications as lightweight filler material for lightweight structures. In this case it is not necessary to process the shells in deuterium. Shells may be sintered in an inert atmosphere at a temperature of at least about 1000° C., preferably about 1200° C. or higher. At a temperature above about 1050° C., sintering in vacuum leads to higher densities than sintering in an inert atmosphere. Also, at temperatures above about 1200° C., the sintering is not influenced by the compacting pressure. Sintering above atmospheric pressure is also possible. Shells fabricated in an inert atmosphere can be laser drilled and filled with deuterium using known prior art procedures.

The described process can be tailored to fabricate shells of a broad range of diameters and a broad range of shell thickness. For example a very small preform core of about 500 microns or less can be coated with several millimeters of beryllium slurry to yield an essentially solid beryllium shell of several millimeters radius. This may be of use in breeder blankets.

This process is also applicable to fabrication of essentially pure metal or metalloid shells including those selected from Be, Mg, Sr, B, Al, Ga, In, Tl, Ti, Zr, Hf, and the rare earths.

The process is especially beneficial to fabricating shells with low free energy including Be, Mg, Al, Zr, Ti, Si, V, Mn, and Cr.

Gas

The hollow shell is filled with a gas selected for use in laser fusion target. Gases include isotopes of hydrogen such as deuterium (D), tritium (T), deuterium-tritium (DT), and compounds thereof such as deuterium sulfide ($D_2S$), deuterated ammonia ($ND_3$), and deuterated silane ($SiD_4$).

The gas may also be selected from a mixture of the rare gases including neon, argon, xenon, krypton, helium, and/or radon, including isotopes of rare gases such as helium-3 and xenon (Xe).

Other gases include nitrogen, $CO_2$, CO, halogens, excimers, oxygen, and mixtures thereof. Isotopes of the above and other gases are contemplated including oxygen-18.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A process of fabricating a hollow beryllium shell which comprises preparing a slurry of a binder and beryllium powder, coating an organic preform with the slurry, heating the preform so as to remove organics in the preform to achieve a hollow shell of beryllium, and firing the hollow beryllium shell in an essentially deuterium atmosphere at an elevated temperature and elevated pressure.

2. The process of claim 1 wherein the firing step occurs in an essentially deuterium atmosphere at a pressure of about 85 to about 110 atmospheres at a temperature of about 1000° C. to about 1300° C.

3. The process of claim 1 wherein the organic preform is removed through pyrolization at a temperature below about 500° C.

4. The process of claim 3 wherein the organic preform is removed through pyrolization at a temperature below about 450° C.

5. The process of claim 4 wherein the organic preform is removed through pyrolization at a temperature below about 425° C.

6. The process of claim 1 wherein the organic preform pyrolizes at a temperature below about 500° C.

7. The process of claim 6 wherein the organic preform pyrolizes at a temperature below about 450° C.

8. The process of claim 7 wherein the preform organics pyrolize at temperature below about 425° C.

9. The process of claim 1 wherein the binder pyrolizes at a temperature below about 500° C.

10. The process of claim 9 wherein the binder pyrolizes at a temperature below about 450° C.

11. The process of claim 10 wherein the binder pyrolizes at a temperature below about 425° C.

12. A process of fabricating a hollow beryllium shell which comprises preparing a slurry of a binder and beryllium powder, coating an organic preform with the slurry, heating the preform so as to remove organics in the preform to achieve a hollow shell of beryllium, and firing the hollow beryllium shell at an elevated temperature, said firing of the hollow shell being in an inert gas atmosphere, a pressurized gas being added to the shell through a hole in the shell, said hole being filled to encapsulate the gas at a pressure above atmospheric.

13. The process of claim 12 wherein the organic preform is removed through pyrolization at a temperature below about 500° C.

14. The process of claim 12 wherein the firing step occurs in an inert atmosphere at a pressure of about 85 to about 110 atmospheres at a temperature of about 1000° C. to about 1300° C.

15. The process of claim 12 wherein the organic preform is removed through pyrolization at a temperature below about 500° C.

16. The process of claim 15 wherein the organic preform is removed through pyrolization at a temperature below about 450° C.

17. The process of claim 16 wherein the organic preform is removed through pyrolization at a temperature below about 425° C.

18. The process of claim 12 wherein the organic preform pyrolizes at a temperature below about 500° C.

19. The process of claim 18 wherein the organic preform pyrolizes at a temperature below about 450° C.

20. The process of claim 19 wherein the preform organics pyrolize at temperature below about 425° C.

21. The process of claim 12 wherein the binder pyrolizes at a temperature below about 500° C.

22. The process of claim 21 wherein the binder pyrolizes at a temperature below about 450° C.

23. The process of claim 22 wherein the binder pyrolizes at a temperature below about 425° C.

* * * * *